US009097044B2

(12) United States Patent
Mayer et al.

(10) Patent No.: US 9,097,044 B2
(45) Date of Patent: Aug. 4, 2015

(54) STOPPERS FOR DOORS AND/OR WINDOWS

(75) Inventors: Frank F. E. Mayer, Bad Duerkheim (DE); Ralph Kraemer, Saarbruecken (DE)

(73) Assignee: F. E. Frank Mayer, Bad Duerkheim (DE)

( * ) Notice: Subject to any disclaimer, the term of this patent is extended or adjusted under 35 U.S.C. 154(b) by 0 days.

(21) Appl. No.: 14/241,674

(22) PCT Filed: Aug. 28, 2012

(86) PCT No.: PCT/EP2012/003616

§ 371 (c)(1),
(2), (4) Date: Apr. 23, 2014

(87) PCT Pub. No.: WO2013/029782

PCT Pub. Date: Mar. 7, 2013

(65) Prior Publication Data

US 2014/0338149 A1 Nov. 20, 2014

(30) Foreign Application Priority Data

Aug. 29, 2011 (DE) ..... 10 2011 111 350

(51) Int. Cl.

| | |
|---|---|
| ***E05F 5/02*** | (2006.01) |
| ***E05C 19/18*** | (2006.01) |
| ***E05C 17/54*** | (2006.01) |
| *E05B 15/16* | (2006.01) |

(52) U.S. Cl.

CPC ..... *E05C 19/18* (2013.01); *E05C 17/54* (2013.01); *E05B 15/1635* (2013.01); *Y10T 16/61* (2015.01)

(58) Field of Classification Search

CPC ..... E05C 17/00; E05C 17/54; E05C 17/025; Y10S 292/15; E05Y 21/21; E05Y 21/218; E05Y 21/2201; E05F 5/00; E05F 5/06; E05F 5/02

USPC .... 16/82, 85, 86 R, 86 A, 86 B; 292/DIG. 15, 292/DIG. 19, 342, 343, 297, 304, 288, 339

See application file for complete search history.

(56) References Cited

U.S. PATENT DOCUMENTS

| | | | | | |
|---|---|---|---|---|---|
| 2,120,692 | A | * | 6/1938 | Butts | 292/343 |
| D197,049 | S | * | 12/1963 | Panopoulos | D8/402 |
| 3,706,112 | A | * | 12/1972 | Newell | 16/82 |
| 5,339,492 | A | * | 8/1994 | Billew | 16/82 |

(Continued)

FOREIGN PATENT DOCUMENTS

| | | |
|---|---|---|
| DE | 8610466 | 5/1986 |
| DE | 9311237 | 9/1993 |

(Continued)

*Primary Examiner* — Chuck Mah

(74) *Attorney, Agent, or Firm* — Jordan and Hamburg LLP

(57) ABSTRACT

A door and/or window stopper includes two branches each having a contour tapering toward a tip and further includes a coupling body, which is at least partially made of rubber or a flexible, rubber-like thermoplastic material or elastomer, wherein at least outer surfaces of the branches have a relatively high friction coefficient. The two branches have inner surfaces, which are connected to each other in a connecting region and extend away from each other outward to tips of the branches. The two branches are connected to each other by way of a connecting body and disposed in a V-shaped manner. Proceeding from the respective tips, the outer surfaces of the branches extend at decreasing distances toward the coupling body.

19 Claims, 5 Drawing Sheets

(56) References Cited

U.S. PATENT DOCUMENTS

| | | | | |
|---|---|---|---|---|
| 5,547,238 | A * | 8/1996 | Payette | 292/343 |
| 7,690,080 | B1 * | 4/2010 | Coffman, II | 16/82 |
| 8,365,355 | B2 * | 2/2013 | Liu | 16/82 |
| 2005/0225100 | A1 * | 10/2005 | Pendergrass | 292/343 |
| 2010/0289280 | A1 * | 11/2010 | Nadrowski | 292/343 |

FOREIGN PATENT DOCUMENTS

| | | | |
|---|---|---|---|
| EP | 2 069 598 | | 6/2009 |
| GB | 2424920 | A * | 10/2006 |
| JP | 2002089118 | A * | 3/2002 |
| JP | 2006009537 | A * | 1/2006 |
| WO | WO-2008/040518 | | 4/2008 |

* cited by examiner

Fig. 9
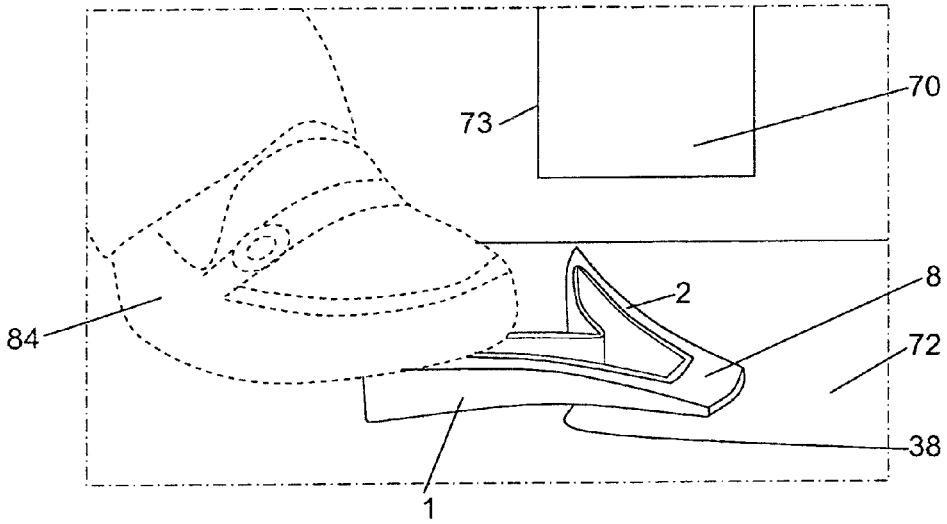
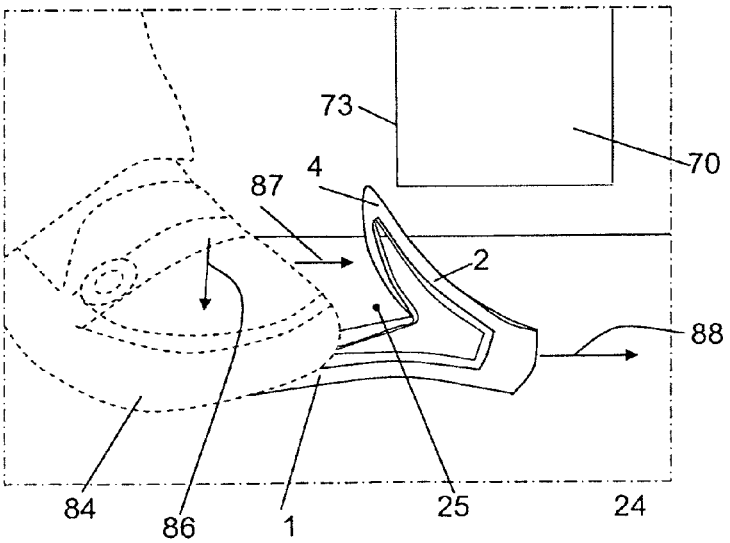
Fig. 10

STOPPERS FOR DOORS AND/OR WINDOWS

BACKGROUND OF THE INVENTION

The invention relates to a door and/or window stopper.

A door and/or window stopper is known from EP 2 069 598 B1, which has an outer contour tapering at least toward a tip and which preferably includes an inner cavity that essentially corresponds to the outer contour. The stopper comprises an outer part made of rubber or a flexible rubber-like thermoplastic material having a relatively high friction coefficient and an inner part that is enclosed by the outer part and has increased flexural rigidity as compared to the outer part. The stopper further has two arms converging toward the above-mentioned tip, which are connected to each other in the region of the tip. At least one of these arms of the inner part has decreasing wall thicknesses toward the tip, so that the wall thickness of the inner part and/or of the arm thereof there is greater than in an end region in which the arms are connected to each other. This door and/or window stopper has been tried and tested for many applications. However, if the distances or gaps between doors or windows and the floor or a frame are relatively large when these are open, difficulties with handling the known stopper may arise. In principle, the stopper could be dimensioned larger, but this would increase the production complexity and material expenditure. In addition, the weight, and thus the handling, would be disadvantageously influenced.

SUMMARY OF THE INVENTION

Proceeding from this, it is the object of the invention to improve the door and/or window stopper of the type mentioned above to the effect that the identified disadvantages are avoided, in particular to allow use and/or simple handling with relatively large distances between a door or a window and the floor and/or frame when opened. At the same time, the door and/or window stopper should also be usable with comparatively small distances and/or gaps. In addition, low production complexity and material expenditure should be required, wherein high flexibility, and use over a wide range of the above-mentioned distances or gaps, are to be made possible.

The door and/or window stopper according to the invention, hereinafter referred to as a stopper for short, is characterized by a simple design and allows relatively large gaps or distances between doors or windows and the floor or frame, when these are opened, to be bridged, so as to achieve functionally reliable stopping of the doors or windows, while ensuring low material use and/or high flexibility. The stopper has at least two branches that are connected to a coupling body and, proceeding from the coupling body, diverge in a V-shaped manner and/or are disposed so as to be straddled. Advantageously, the two tips of the branches and the end of the coupling body form an approximately equilateral triangle. This has been found to be particularly advantageous for disposing the tips of the branches at a distance from each other which is substantially and/or at least approximately equal to the distance from at least one of the above-mentioned tips to the end of the coupling body. The branches have inner surfaces originating in a connecting region, which faces the coupling body and/or is associated therewith, and ending at the tips. The coupling body further has two outer surfaces that are adjoined by outer surfaces of the respective branch, wherein the outer surfaces of the branches likewise end at the branch tips. The branches are, in particular, preferably designed to be conically tapered toward the tips, wherein a clearance is present between the inner surfaces of the two branches. The branches are advantageously designed to be concave/convex and/or, toward the tips thereof, they extend in opposite directions away from each other to the side and/or to the outside. The branches are advantageously curved, wherein the inner surfaces connected to each other are convex and the outer surfaces are concave. The preferably conical inner surfaces are preferably adjoined by the outer surfaces of the branches in the region of the tips, these outer surfaces preferably extending concavely back to the coupling body or the outer surfaces thereof. As an alternative, as part of the invention, the branches originating from the coupling body in a straddled V-shaped manner can be designed so that at least the respective inner surface and/or outer surface are designed to be substantially planar.

When the stopper is inserted into a gap between a door or a window and a floor or a frame, the branches are straddled apart, wherein the distance to the tips is increased and pretension is generated in such a way that the stopper is clamped in the gap, wherein a retaining force is predetermined. After the stopper has been inserted into a gap, the pretension, and thus the retaining force, may be easily predetermined and/or increased, in particular by pressing the branches and/or the tips together. As a result of the tapering of the branches toward the tips, high flexibility and/or a long spring travel are advantageously achieved. The clearance that is present between the branches and/or the inner surfaces thereof is designed so that the insertion of the stopper into a gap and/or the movements of the arms for predetermining and/or increasing the pretension or retaining force can be carried out with functional reliability.

In a preferred embodiment, the stopper and/or the branches thereof comprise at least one inner cavity. The cavity is located within a clamp-like inner part which, in the region of the branches, includes two arms that have increased flexural rigidity as compared to an outer part. The outer part of the stopper, or at least the outer edge of the stopper and/or of the branches thereof, is made of rubber or a flexible, rubber-like thermoplastic material and/or an elastomer having a relatively high friction coefficient, whereby functionally reliable fixation on a door or a window, or the associated frame parts or a floor, is achieved. It is further of significance that the arms of the inner part of the respective branch have decreasing wall thicknesses toward the tip, so that the wall thickness of the inner part and/or of the arm thereof is smaller in the region of the tip than in the above-mentioned connecting region and/or in the region of the coupling body.

The stopper has two substantially planar surfaces, which are at a predetermined and/or relatively small distance from each other in the region of the end of the base body. The distance of the mutually opposing surfaces increases toward the branches and/or the above-mentioned tips. The stopper thus has a wedge-shaped design and, when one of the surfaces thereof rests flat on the floor, can be pushed or kicked underneath a door, for example by way of a foot, so as to stop a door with a relatively narrow gap. The stopper advantageously has a lesser depth or thickness in the region of the coupling body than at the tips. In this way, significant material savings are achieved, wherein nonetheless there is high rigidity transverse to the surfaces, and buckling or bending orthogonal to the surfaces is prevented. If a comparatively large gap is present, the stopper, when oriented vertically, is advantageously used in such a way that the branches and/or tips are placed on the floor and the coupling body engages on the bottom of the door. For this purpose, the stopper, which initially rests flat on the floor, can be righted by 90°, in particular by stepping with the foot onto one of the tips, and inserted or pressed into the gap. It is further particularly advantageous that the pretension and/or retaining force can be increased in a simple manner by engaging, for example the tip of a foot, into the above-mentioned clearance and lifting or moving the connecting region in the direction of the coupling body. According to the invention, the pretension can further be generated and/or increased by pushing together or pressing together the branches, for example by stepping onto a branch and/or pressing the branch in the direction of the other branch, whereby the retaining force is predetermined and/or increased as needed.

In a particular embodiment of the invention, the at least one branch of the stopper, and/or the stopper as a whole, comprises an inner part, which is enclosed by the soft material and/or rubber or a flexible, rubber-like thermoplastic material or elastomer and has increased flexural rigidity compared to the same. On such a stopper, the inner part surrounds a cavity. Such a stopper is known in particular from EP 2 069 598 B1 mentioned above, or international PCT patent application WO 2008/040518, the disclosure of which is hereby made the subject matter of the present patent application. The preferably clamp-like inner part and/or the component comprising at least one inner part is designed, in the overall, so that the edges do not protrude over at least one surface of the stopper, but are particularly advantageously recessed toward the inside and/or the back with respect to the surface, or surfaces, at a predetermined distance.

The respective edge is at the predetermined and/or small distance from the associated surface, this distance preferably being predetermined in the range of 0.5 to 2 mm, and more particularly of 1 to 1.5 mm. Because of the proposed design and/or connection of the comparatively hard inner part and/or component to the surrounding soft material and/or rubber and/or flexible rubber-like thermoplastic material or elastomer, the latter protrudes slightly over the comparatively hard material of the inner part or component. It is therefore possible to design or produce the soft and resilient material particularly thin, and/or to prevent detachment and/or crushing of the comparatively soft and thin material. According to the invention, the clamp-like inner part and/or component, which is surrounded by the above mentioned soft material, such as rubber or plastic material or the like, and basically forms a hard inner core of the stopper, has a lesser depth than the surrounding comparatively soft material, such as rubber or elastomer or the like.

Special embodiments and refinements of the stopper according to the invention are provided in the description of the special exemplary embodiment described hereafter based on the drawings.

The invention will be described in greater detail hereafter based on the special exemplary embodiments shown in the drawings, without thereby limiting the invention in this respect. In the drawings:

BRIEF DESCRIPTION OF THE DRAWINGS

FIGS. 9, 10 are illustrations of a special use of the stopper; and

DETAILED DESCRIPTION OF PREFERRED EMBODIMENTS

Figure 1:
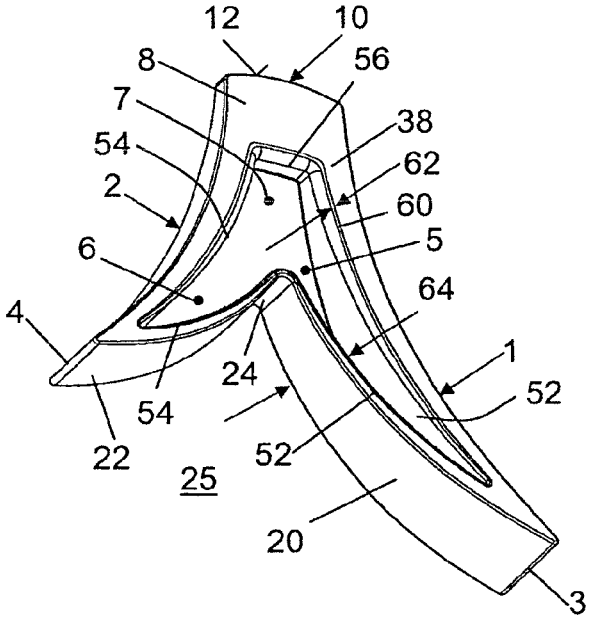
FIG. 1 is a perspective illustration of the stopper comprising an inner cavity.
Figure 2:
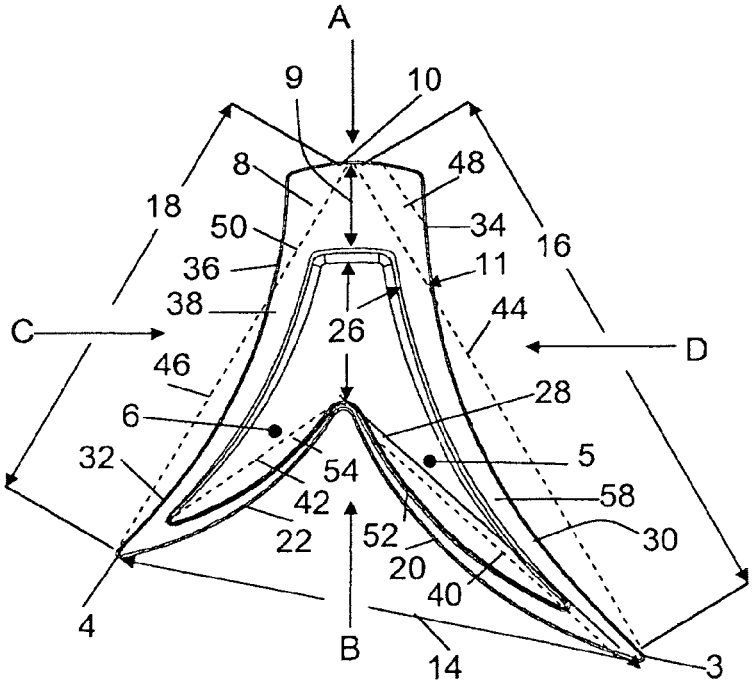
FIG. 2 is a front view of the stopper according to FIG. 1.
Figure 3:
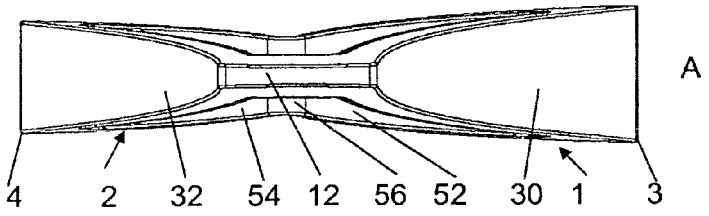
FIG. 3 to 6 are views of the stopper in viewing directions A to D according to FIG. 2.
Figure 4:
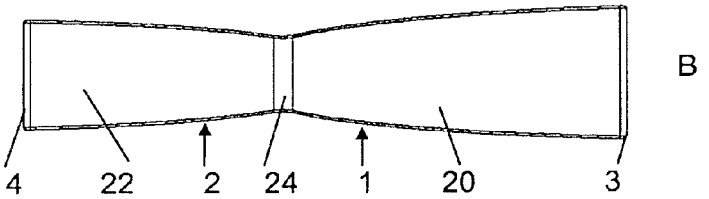
Figure 5:
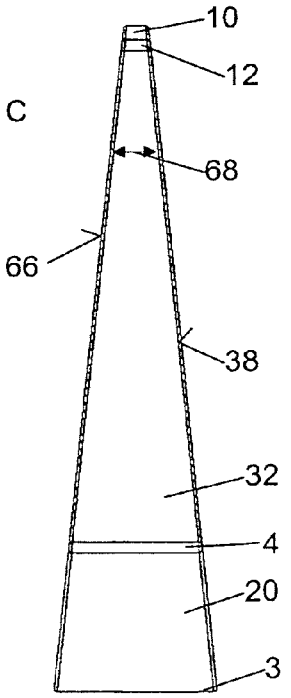
Figure 6:
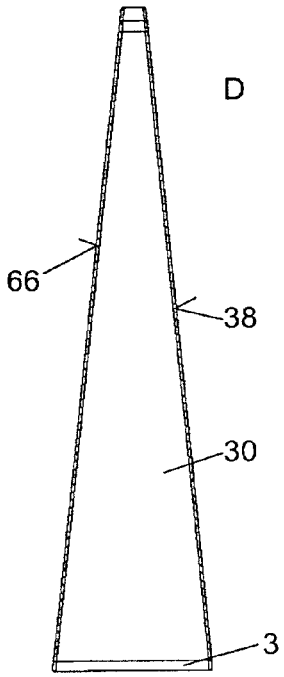

FIGS. 1 and 2 show the stopper comprising two branches 1, 2, which have tips 3, 4. The branches 1, 2 have inner cavities 5, 6 designed as apertures, and are connected to each other by way of the coupling body 8. The branches 2, 3 have a substantially wedge-shaped design, wherein the cavities 5, 6 preferably open into a shared and/or uniform cavity 7 that is delimited by the coupling body 8. The coupling body 8 is substantially rectangular and has a predetermined length 9 and/or advantageously comprises a convexly curved end face 12 at the free end 10. The length 9 is greater than the width 11 of branch 1 or 2 by a predetermined factor in the transition region to the coupling body 8. This factor is advantageously in a range between 1.5 and 3.5, and preferably between 2 and 2.5. The branches 1, 2 are disposed in a V-shaped manner, wherein the tips 3, 4 are at a distance 14.

The branches 1, 2 preferably have differing lengths, so that the stopper can be optimally used with respect to different usage conditions and/or gaps between doors or windows and a floor or frame. As is apparent, the tip 3 of the longer branch 1 is at a distance 16 from the end 10, while the tip 4 of the short branch 2 is at the distance 18 from the end 10. The distance 14 is advantageously at least approximately equal to the distance 16, while the distance 18 is smaller than the distance 14 by a predetermined magnitude. As part of the invention, the tips 3, 4 of the branches 1, 2, together with the remote end 10 of the connecting body 8 and/or of the stopper, form an at least approximately equilateral triangle, whereby the use of the stopper for bridging relatively large gaps between doors or windows is made possible, in particular with low material expenditure and/or weight.

The branch 1 has a convex inner surface 20, and the branch 2 likewise has a convex inner surface 22, wherein the two inner surfaces 20, 22 adjoin each other in a preferably convex connecting region 24. The connecting region 24 has a distance 26 from the end 10 which is at least approximately equal to the distance 28 from the tip 3 of branch 1. A clearance and/or a notch, or the notch 25, is present between the branches 1, 2 and/or the inner surfaces 20, 22 thereof. The clearance 25 is designed so that, during insertion of the stopper into a gap, the branches 1, 2 can be moved so as to predetermine the pretension and/or retaining force, in particular while giving consideration to the flexibility of the branches, and the stopper can be easily inserted into the gap. The clearance 25 is further designed so that the branches 1, 2 can be pressed against each other, above all so as to predetermine and/or increase the pretension and/or retaining force.

The branch 1 has a concave outer surface 30, and the branch 2 likewise has a concave outer surface 32. The outer surfaces 30, 32 advantageously adjoin likewise concave outer surfaces 34, 36 of the coupling body 8. The front surface 38 of the stopper, or of the branches 1, 2 thereof, and of the coupling body 8 is preferably substantially planar and/or at least approximately orthogonal to the above-mentioned outer surfaces.

In an alternative embodiment of the stopper according to the invention, the inner surfaces and/or outer surfaces can essentially be designed as planar areas, as is indicated by the dotted lines 40, 42 or 44, 46. As part of the invention, the outer surfaces of the coupling body 8 can moreover be designed as planar areas and/or can converge toward and/or adjoin each other in the region of the end 10, as is indicated by dotted lines 48, 50. As part of the invention, the aforementioned outer surface can further be designed to be polygonal, either entirely and/or partially, as can be the aforementioned inner surface of the branches 1, 2.

The branches 1, 2 comprise clamp-like inner parts 52, 54, which surround the cavities 5, 6 and 7 and comprise arms, which are connected to each other at a distance from the tips 3, 4. It is of particular significance that the wall thicknesses of at least one arm of each branch 1, 2 decreases toward the respective tip 3, 4. In this way, improved flexibility and/or increased spring travel are achieved, whereby buckling of the branches, and of the stopper as a whole, transverse to the surface 38 is avoided. As is apparent, the arms of the inner parts 52, 54 which are located closest to the outer surfaces 30, 32 extend to the coupling body 8, where they are connected to each other by way of a connecting arm 56. In the region between the connecting region 24 and the coupling body 8, the inner cavity 7 is surrounded by opposing parts of the branches 1, 2 and the coupling body 8, in particular by the inner parts 52, 54 present there and the connecting arm 56. The inner parts, together with the connecting arm 56, are advantageously designed in one piece, or as a single component. The inner parts 52, 54 and the connecting arm 56 are preferably entirely surrounded by an outer part 58 and are rigidly and integrally connected thereto. The outer part 58 forms the outer edge of the stopper and is advantageously made of rubber or a flexible, rubber-like thermoplastic material and/or elastomer. The outer part comprises the above-described inner surfaces 20, 22, the outer surfaces 30, 32, 34, 36 and the end face 12. At least the aforementioned areas have a relatively high friction coefficient, so that reliable fixation of the stopper on doors or windows, and the frames thereof or a floor, is made possible. The coupling part 8 forms a part of the outer part 58 and is designed in one piece therewith.

The edge 60 of the respective inner part 52, 54 facing the front surface 38 and/or located beneath the same and/or associated therewith and, in corresponding fashion, the edge of the connecting arm 56 and/or of the aforementioned component as a whole are at a predetermined and/or small distance 62 from the front surface 38. Analogously, the edge and/or edges associated with the surface of the stopper, which is located behind the drawing plane, can be at a predetermined and/or small distance from this surface. According to the invention, these edges do not protrude over the front surface 38 and/or the rear surface of the stopper, but are located at a lower level and/or beneath at least one of the surfaces. In other words, the depth of the inner part or inner parts 52, 54 and/or of the connecting arm 56 is at least equally as large as, and preferably smaller by the predetermined distance than, the thickness 64 of the stopper in the respective shared cutting plane. As will be described hereafter, it shall already be mentioned here that the front surface and the rear surface of the stopper are disposed at a predetermined angle relative to each other.

FIGS. 3, 4, 5 and 6 show views of the stopper in the viewing directions A, B, C and D. As is easily apparent from FIGS. 5 and 6, an angle 68 is predetermined between the front surface 38 and the rear surface 66 mentioned above. The stopper thus has a wedge-shaped design and, when one surface thereof rests flat on the floor, can be pushed underneath a door, for example by way of a foot, so as to stop a door with a relatively narrow gap. The stopper thus has a considerably larger width at the tips 3 and 4 than in the region of the end 10, whereby considerable savings of material and/or weight are also achieved. As an alternative to the planar design of the surfaces 38, 66 shown, these may further be curved and/or arched and/or undulated as part of the invention.

Figure 7:
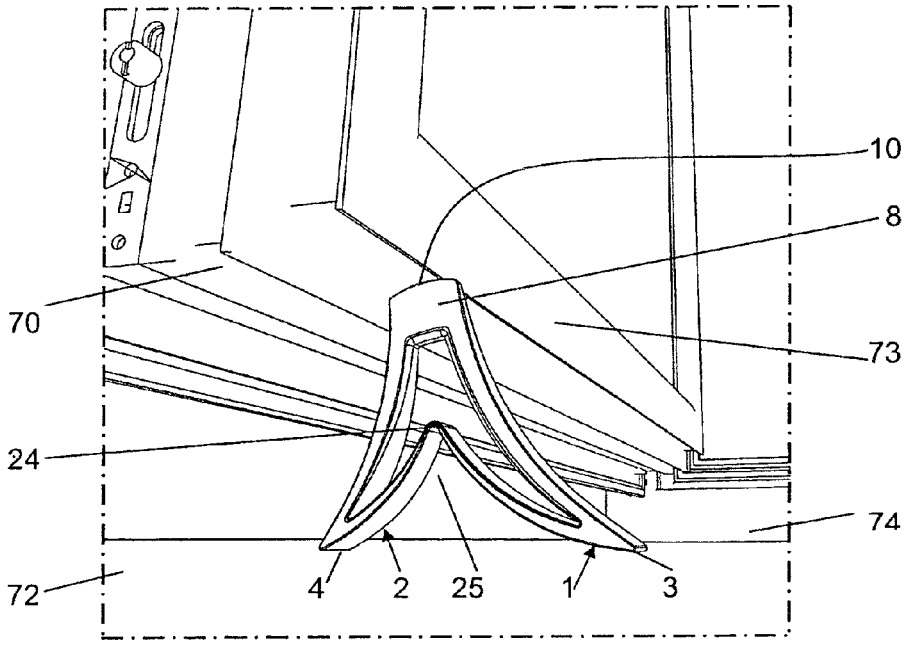
FIG. 7 is a schematic illustration of the stopper with an open door.

FIG. 7 shows the use or application of the stopper according to the invention for stopping a partially illustrated door leaf 70 with respect to the floor 72 or the door frame 74. The stopper is placed on the floor 72 with the branch 1, or the tip 3 thereof, and with the branch 2, or the tip 4 thereof, wherein the end 10 and/or the coupling body 8 rest against a lower profile section of the door leaf 70. The stopper is clamped with pretension into the gap between the floor and the lower profile of the door leaf 70, wherein as a result of the flexibility of the branches 1 and 2 the distance that is present previously, in the non-clamped state of the stopper, between the tips 3 and 4 is increased. If the door leaf 70 is now moved in one or the other direction, for example due to a draft, the load is decreased on one of the branches 1, 2, so that the pretension of this branch is reduced and it can move toward the other branch, whereby clamping is preferably improved. Moreover, in the illustrated upright position of the stopper, it is easily possible to increase the pretension, and thus the retaining force of the stopper, by stepping with the tip of the foot into the clearance 25 between the two branches 1, 2 and thereby lifting up the connecting region 24. This reduces the distance between the tips 3, 4, and increases the retaining force and/or the pretension in a simple manner.

Figure 8:
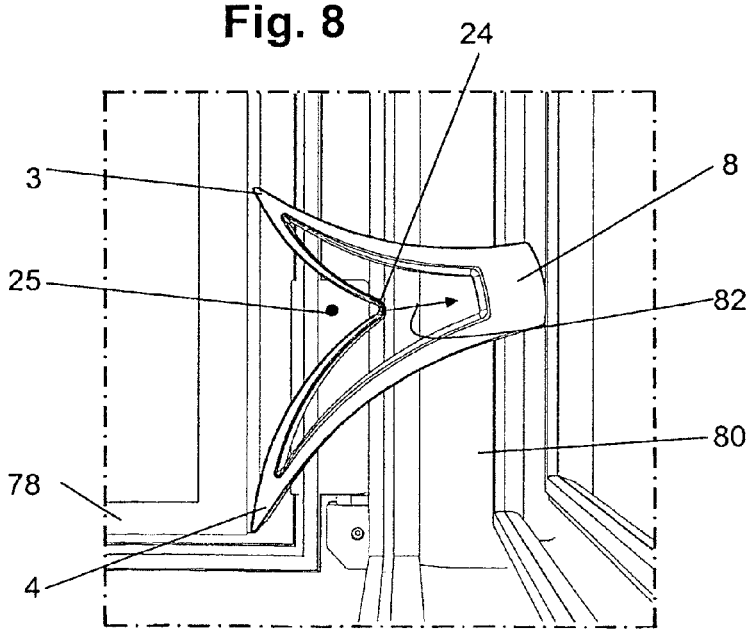
FIG. 8 is a schematic illustration of the stopper with an open window.

FIG. 8 shows the use of the stopper, which in the case of an open window sash 78 is inserted between a vertical profile of the same and a window frame, where it is advantageously clamped with pretension. The pretension, and thus the retaining force, can be easily increased by pressing the tips 3, 4 together with the hand, or by engaging in the clearance and pressing the connecting region 24 in the direction of the arrow 82.

As an alternative to the use according to FIG. 7, in which the stopper rests on the floor with the two branches 1, 2, the stopper can further be inserted into the clearance or gap between the door leaf 70 and the floor 72 in a position that is rotated clockwise by 90°, so that both the branch 1 and the coupling body 8 rest on the floor, wherein the branch 2 and/or the tip thereof in particular rest against a vertical area 73 of the door leaf 70. The stopper may further be used according to the invention in such a way that the short branch 2 and the coupling body 8 rest on the floor 72, wherein the long branch 1 rests against the door leaf 70, in particular against the vertical area 73 thereof. Another application option or usage of the stopper exists to the effect that the coupling body 8 is disposed in the clearance or gap between the door leaf 70 and the floor 72, wherein either the long branch 1 or the short branch 2 is caused to engage with and/or be seated against the door leaf 70. These different uses of the stopper according to the invention can alternatively also be provided for windows as part of the invention wherein, instead of the floor, a window sill, for example, or the clearance between the window sash and the window sill, is provided for seating and/or placing the stopper on. According to the invention, the respective use of the stopper can be predetermined in particular as a function of the size of the gap, or of the distance, between the door or the bottom thereof, or between the window or the frame thereof, and in particular a window sill.

Another use of the stopper will be described based on FIGS. 9 and 10, wherein according to FIG. 9 the stopper initially rests flat on the floor 72, more particularly with the front surface 38 thereof, and is pushed partially beneath the door leaf 70, preferably way of a foot 84 indicated with dotted lines. This is done in such a way that at least the coupling body 8 is located underneath the opened door leaf 70, while the long branch 1 is located in front of the door leaf 70 so that a person, as shown, can set the foot 84 on the branch 1. As an alternative, the stopper is further pushed underneath the door leaf 70 so that the foot 4 can be set on the short branch 2. If the user now sets his foot or shoe 84 more strongly, or with increased force, on the branch 1 in the direction of the arrow 86 according to FIG. 10, the stopper is deformed so that the other branch 2 projects from the floor 72 and in total is rotated 90°, so that the branch 2, or the tip 4 thereof, is located substantially vertically above the floor 72. By moving the foot 84 in the direction of the arrow 87, the foot enters the clearance or the notch 25 between the branches 1 and 2, so that further movement pushes the stopper in the direction of the arrow 88 slightly further underneath the door leaf 70, which is thus stopped in the necessary manner and/or wherein the necessary pretension of the stopper for the purpose of stopping the door leaf is predetermined. The pretension, and consequently the clamping force, are thus advantageously increased. It is of particular significance that the pretension or clamping force is predetermined by tensile loading, or as tensile stress, and not by a compressive force from above. It is advantageously achieved in this way that the foot is not in the way, interfering at the upper edge of the stopper, and/or that the highest point or region of the stopper can thus be utilized. Optimal utilization of the size and/or of the material use of the stopper is thus achieved. The stopper can thus even be used for large distances between the door leaf 70 and the floor 72, and more particularly with low material expenditure and/or a small size.

Figure 11:
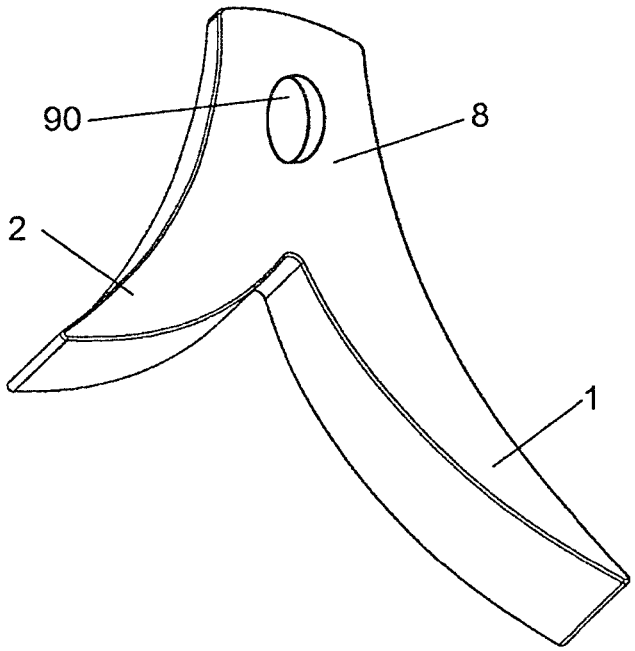
FIGS. 11, 12 show one embodiment of the stopper without a clamp-like inner part.
Figure 12:
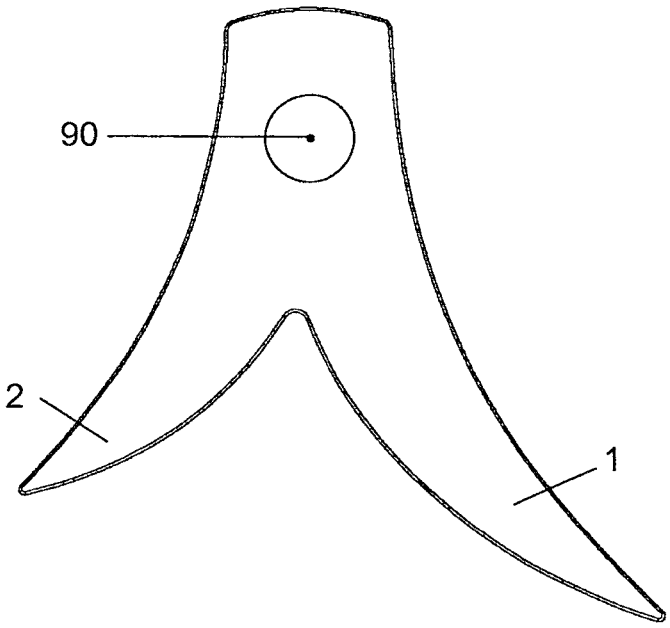

FIGS. 11 and 12 show one special embodiment of the stopper, which is designed as a solid version and/or is made of solid rubber or a flexible, rubber-like thermoplastic material or elastomer and does not have any clamp-like inner parts. This stopper comprises the branches 1 and 2 and the coupling body 8. The coupling body 8 can, in particular, have a cavity 90 in another alternative embodiment, preferably for the purpose of saving material and weight. Otherwise, the descriptions provided above apply analogously to this embodiment of the stopper.

The invention claimed is:

1. A door and/or window stopper made at least partially of rubber or a flexible, rubber-like thermoplastic material or elastomer and comprising:

a body portion; and two branch portions that are coplanar in a first plane and are connected to each other by the body portion so that the stopper forms a V-shape;

wherein each one of the two branch portions tapers toward a tip;

wherein an outer surface of said each one of said two branch portions is orthogonal to said first plane and has a relatively high friction coefficient;

wherein said each one of the two branch portions has a first inner surface orthogonal to said first plane, said first inner surface being connected to the first inner surface of another of said two branch portions in a connecting region and extending away from the connecting region toward said tip;

wherein for each said one of said two branch portions, proceeding from the tip toward the coupling body, the outer surface of said one of the two branch portions extends, along at least a partial length of said outer surface, toward another of the two branch portions; and wherein a first distance between the tip of said one branch portion and the tip of said other branch portion is equal to a second distance from the tip of said one branch portion to a distal end of said body portion.

2. The stopper according to claim 1, wherein at least a first length portion of said inner surface is convex, and wherein at least a first length portion of said outer surface is concave.

3. The stopper according to claim 1, wherein at least a first length portion of said inner surface is substantially planar, and wherein at least a first length portion of said outer surface is substantially planar.

4. The stopper according to either claim 1, wherein the two branch portions are configured so that a clearance between said inner surface of said one branch portion in a vicinity of said tip and said inner surface of said other branch portion in a vicinity of said tip can be changed by pressing the two branch portions together during insertion of the stopper into a gap, said clearance defining a retaining force which increases as the two branch portions are pressed closer together.

5. The stopper according to claim 1, wherein the connecting region is configured so that a movement of the connecting region toward the body portion increases a retaining force of the stopper.

6. The stopper according to claim 1, wherein the body portion has a width spanning from a side of the body portion at said one branch portion to an opposite side of the body portion at said other branch portion, wherein the body portion has a length along an axis toward the connection region, said length of said body portion being greater by a predetermined factor than a width of said one branch portion at a location of said one branch portion extending from said body portion.

7. The stopper according to claim 6, wherein the factor is from 1.5 to 3.5.

8. The stopper according to claim 6, wherein the factor is from 2 to 2.5.

9. A door and/or window stopper made at least partially of rubber or a flexible, rubber-like thermoplastic material or elastomer and comprising:

a body portion; and two branch portions that are coplanar in a first plane and are connected to each other by the body portion so that the stopper forms a V-shape;

wherein each one of the two branch portions tapers toward a tip;

wherein an outer surface of said each one of said two branch portions is orthogonal to said first plane and has a relatively high friction coefficient;

wherein said each one of the two branch portions has a first inner surface orthogonal to said first plane, said first inner surface being connected to the first inner surface of another of said two branch portions in a connecting region and extending away from the connecting region toward said tip;

wherein for each said one of said two branch portions, proceeding from the tip toward the coupling body, the outer surface of said one of the two branch portions extends, along at least a partial length of said outer surface, toward another of the two branch portions; and wherein a first distance between the connecting region and a distal end of the body portion is at least as long as a second distance between the connecting region and the tip of said one of the two branch portions.

10. A door and/or window stopper made at least partially of rubber or a flexible, rubber-like thermoplastic material or elastomer and comprising:

a body portion; and two branch portions that are coplanar in a first plane and are connected to each other by the body portion so that the stopper forms a V-shape;

wherein each one of the two branch portions tapers toward a tip;

wherein an outer surface of said each one of said two branch portions located between said first edge and second edge is orthogonal to said first plane and has a relatively high friction coefficient;

wherein for each said one of said two branch portions, proceeding from the tip toward the coupling body, the outer surface of said one of the two branch portions extends, along at least a partial length of said outer surface, toward another of the two branch portions;

wherein a first distance between the tip of said one branch portion and the tip of said other branch portion is equal to a second distance from the tip of said one branch portion to a distal end of said body portion; and wherein each said one branch portion is solid for a length portion extending from said tip to an inner-peripheral surface vertex of said V-shape.

11. A door and/or window stopper made at least partially of rubber or a flexible, rubber-like thermoplastic material or elastomer and comprising:

a body portion; and two branch portions that are coplanar in a first plane and are connected to each other by the body portion so that the stopper forms a V-shape;

wherein each one of the two branch portions tapers toward a tip;

wherein an outer surface of said each one of said two branch portions is orthogonal to said first plane and has a relatively high friction coefficient;

wherein said each one of the two branch portions has a first inner surface orthogonal to said first plane, said first inner surface being connected to the first inner surface of another of said two branch portions in a connecting region and extending away from the connecting region toward said tip; and wherein for each said one of said two branch portions, proceeding from the tip toward the coupling body, the outer surface of said one of the two branch portions extends, along at least a partial length of said outer surface, toward another of the two branch portions; and the stopper further comprising a V-shaped cavity having a base wall formed by said body portion and having branch walls extending as inner surfaces of said each one branch portion toward the tip of said each one branch portion.

12. The stopper according to claim 11, wherein in a direction parallel to said first plane, a first thickness of said each one branch portion decreases along a length of said one branch portion toward said tip.

13. The stopper according to claim 11, wherein said each one branch portion comprises an inner material and an outer material covering the inner material, and wherein the inner material is more rigid than the outer material.

14. A door and/or window stopper made at least partially of rubber or a flexible, rubber-like thermoplastic material or elastomer and comprising:

a body portion; and two branch portions that are coplanar in a first plane and are connected to each other by the body portion so that the stopper forms a V-shape;

wherein each one of the two branch portions tapers toward a tip;

wherein an outer surface of said each one of said two branch portions is orthogonal to said first plane and has a relatively high friction coefficient;

wherein said each one of the two branch portions has a first inner surface orthogonal to said first plane, said first inner surface being connected to the first inner surface of another of said two branch portions in a connecting region and extending away from the connecting region toward said tip; and wherein for each said one of said two branch portions, proceeding from the tip toward the coupling body, the outer surface of said one of the two branch portions extends, along at least a partial length of said outer surface, toward another of the two branch portions; and the stopper further comprising a respective reinforcing member disposed within each one of said two branch portions.

15. The stopper according to claim 14, further comprising a connecting arm connecting the reinforcing member of said each one branch portion.

16. A door and/or window stopper made at least partially of rubber or a flexible, rubber-like thermoplastic material or elastomer and comprising:

a body portion; and two branch portions that are coplanar in a first plane and are connected to each other by the body portion so that the stopper forms a V-shape;

wherein each one of the two branch portions tapers toward a tip;

wherein an outer surface of said each one of said two branch portions is orthogonal to said first plane and has a relatively high friction coefficient;

wherein said each one of the two branch portions has a first inner surface orthogonal to said first plane, said first inner surface being connected to the first inner surface of another of said two branch portions in a connecting region and extending away from the connecting region toward said tip;

wherein for each said one of said two branch portions, proceeding from the tip toward the coupling body, the outer surface of said one of the two branch portions extends, along at least a partial length of said outer surface, toward another of the two branch portions; and wherein in a direction normal to said first plane, a second thickness of said each one branch portion increases along a length of said one branch portion toward said tip.

17. A door and/or window stopper made at least partially of rubber or a flexible, rubber-like thermoplastic material or elastomer and comprising:

a body portion; and two branch portions that are coplanar in a first plane and are connected to each other by the body portion so that the stopper forms a V-shape;

wherein each one of the two branch portions tapers toward a tip;

wherein an outer surface of said each one of said two branch portions is orthogonal to said first plane and has a relatively high friction coefficient;

wherein said each one of the two branch portions has a first inner surface orthogonal to said first plane, said first inner surface being connected to the first inner surface of another of said two branch portions in a connecting region and extending away from the connecting region toward said tip;

wherein for each said one of said two branch portions, proceeding from the tip toward the coupling body, the outer surface of said one of the two branch portions extends, along at least a partial length of said outer surface, toward another of the two branch portions; and wherein for each said one branch portion between said outer surface and said inner surface is a facing surface and an adjacent bevel edge surface, the bevel edge surface being of predetermined height relative to said adjacent facing surface.

18. The stopper according to claim 17, wherein said predetermined height is from 0.5 to 2 mm.

19. The stopper according to claim 17, wherein said predetermined height is from 1 to 1.5 mm.

* * * * *